US006672995B2

(12) United States Patent
Baltodano

(10) Patent No.: US 6,672,995 B2
(45) Date of Patent: Jan. 6, 2004

(54) VARIABLE RESISTANCE HAND GRIPPER DEVICE

(76) Inventor: Oscar Baltodano, 1009 N. Adams St., Tallahassee, FL (US) 32303

( * ) Notice: Subject to any disclaimer, the term of this patent is extended or adjusted under 35 U.S.C. 154(b) by 6 days.

(21) Appl. No.: 10/046,949

(22) Filed: Jan. 17, 2002

(65) Prior Publication Data

US 2003/0134729 A1 Jul. 17, 2003

(51) Int. Cl.[7] ..... A63B 21/02
(52) U.S. Cl. ..... 482/121
(58) Field of Search ..... 482/44, 49, 11, 482/121, 127, 126, 128, 47; 601/38; D24/180, 182

(56) References Cited

U.S. PATENT DOCUMENTS

| | | | | | |
|---|---|---|---|---|---|
| 3,570,840 | A | | 3/1971 | Ratchford | |
| D224,547 | S | * | 8/1972 | Lund | 482/11 |
| 3,813,096 | A | * | 5/1974 | Welch | 482/11 |
| D264,739 | S | * | 6/1982 | Cooper | 482/44 |
| 4,332,380 | A | * | 6/1982 | Cardin | 482/49 |
| 4,623,141 | A | | 11/1986 | Salvino | |
| 5,072,927 | A | * | 12/1991 | Santos | 482/44 |
| 5,308,299 | A | * | 5/1994 | Winston | 482/44 |
| 5,556,359 | A | * | 9/1996 | Clementi | 482/49 |
| 5,743,830 | A | * | 4/1998 | Ho | 482/44 |
| 5,746,703 | A | * | 5/1998 | Levatino | 482/11 |
| 5,833,580 | A | | 11/1998 | Chiu | |

* cited by examiner

*Primary Examiner*—Jerome W. Donnelly
(74) *Attorney, Agent, or Firm*—Carnes, Cona & Dixon

(57) ABSTRACT

The present invention is a variable resistance hand gripper ideally suited for use in exercising and strengthening the muscles of the hand and forearm. In order to provide optimum-strengthening capabilities, the present invention includes a plurality of removably resistance devices that are removably secured to the hand gripper device. The user can select the number of resistance devices so as to provide a device that includes adjusting capabilities. The device further comprises a pair of handles pivotally secured and having a upper section and a lower section. The upper section includes the resistance devices and the lower section receives the hands of the user. Adding or removing these conventional resistant elements will provide for the resistance to increase or decrease, as deemed necessary for peak muscle strengthening during utilization by the user.

11 Claims, 3 Drawing Sheets

20a
28
30
24

32
30
20a
28
26
24
18

20a
46
52
50
18
12
10
14
16

VARIABLE RESISTANCE HAND GRIPPER DEVICE

BACKGROUND OF THE INVENTION

1. Field of the Invention

The present invention relates generally to a resistance hand gripper for use in exercising and strengthening the hand and forearm and more particularly to a resistance hand gripper device that utilizes same movement of conventional hand grippers yet includes a means for adjustable tension through resistance by rending a variable resistance device that includes a novel method for increasing or decreasing the tension via the removal or addition of conventional tension elements, such as rubber bands, springs, or the like. The device of the present invention provides for a quick, easy and effective means of adding or removing the particular tension elements used for resistance, inherently providing a device that increases efficiency and productivity for strengthening and working the muscles of the hand and forearm.

2. Background of the Invention

Hand held exercise devices are conventional and well known in the art. Generally, hand held exercise devices are utilized for strengthening the muscles in the forearm and hand that are used for gripping a particular object. This strengthening can be advantageous and will enable a user to improve on a particular sport, hobby, jobs or the like, in which this gripping is essential for success. These hand held exercise devices are also employed for improving deteriorating or injured muscles, such as when a user's hand has suffered an injury such as in an accident or fire. Continuous exercise and therapeutic treatment may greatly increase the strength and dexterity of the deteriorated muscle.

Knowing the benefits of improving and strengthening the muscles of the forearm and hand, it is not surprising that several hand exercise devices have been developed. For example, in U.S. Pat. No. 5,833,580 issued to Chiu wherein disclosed is a grip exercise with a gear-shaped adjusting member having a pair of handles and a receiving head located at the intersection of the two handles, and a gear-like adjusting member housed within the receiving head.

Another example of a hand held exercise device is seen in U.S. Pat. No. 4,623,141 issued to Salvino wherein there is disclosed a hand held arm and hand muscle builder with a means of varying the resistance. This device is comprised of a pair of handles attached to one end of a coiled spring with a flexible tube in the interior of the spring for providing additional tension.

Still another example can be seen in U.S. Pat. No. 3,570,840 issued to Ratchford and U.S. Pat. No. 4,226,412 issued to Panepinto. In these patents there can be seen a hand and finger exerciser, which is comprised of a device having an inner frame and an outer frame wherein the user, grips the inner frame with four fingers of the open hand. The palm and thumb grip the bar of the outer frame. An inner frame being slidably mounted so that it allows for linear movement of the device as the user closes the hand.

Though several hand held exercise devices do exist and have been proven successful, they tend to lack a means of altering resistance and if alternating resistance is available, it is generally difficult and cumbersome to change. Accordingly, it can be seen that there is still a need for providing a device that alters a means of variable resistance as well as a means that simplifies the process of alternating and changing the resistance on the particular exercise device. In doing so, the device should be easy to use and utilize the same movement of common hand grippers, while providing for a small, portable, and light weight device that offers successful results when regularly used.

As will be seen, the present invention achieves its intended purposes, objectives, and advantages by accomplishing the needs as identified above, through a new, useful, and unobvious combination of component elements, which is simple to use, with the utilization of a minimum number of functioning parts, at a reasonable cost to manufacture, assemble, test and by employing only readily available material.

SUMMARY OF THE PRESENT INVENTION

The present invention is a variable resistance hand gripper ideally suited for use in exercising and strengthening the muscles of the hand and forearm. In order to provide optimum-strengthening capabilities, the present invention includes a means of adjusting the resistance by variable resistance method, which utilizes conventional resistant elements, such as springs, rubber bands, or the like. Adding or removing these conventional resistant elements will provide for the resistance to increase or decrease, as deemed necessary for peak muscle strengthening during utilization by the user.

To enable for such an apparatus that is designed and configured to be used in exercising and strengthening the muscles of the hand and forearm, the variable resistance hand gripper device of the present invention comprises a pair of handles. Each handle being a unitary member and having an upper section and a lower section. Preferably the lower section will be longer in length than the upper section so as to render the lower section to receive the hand of the user and provide for a comfortable fit.

Coupling the handles together is a hinge member that provides for the user to press the handles towards and away from each other. This hinge member defines the sections. Thereby providing for the area above the hinge to be defined as the upper area and the area below the hinge to be defined as the lower area. The upper area and lower area of each handle form the unitary member.

The upper section includes a plurality of receiving members. These receiving members will receive at least one removable resistance element. The adding or removing of elements innately increases or decreases the resistance capability of the device of the present invention. Consequently providing for a device that allows the user to select the resistance for their particular level. As the user gains strength in the muscles of the hand and arm, the user can easily and efficiently add to the resistance providing for a more difficult routine when utilizing the present invention.

Accordingly, it is the object of the present invention to provide a variable resistance hand gripper, which will overcome the deficiencies, shortcomings, and drawbacks of prior hand gripper devices specifically geared toward arm and hand exercising and strengthening devices.

Still another object of the present invention is to provide for a variable resistance hand gripper that utilizes the same movement of conventional hand grippers, yet allows for quick and easy resistance adjustments, thereby providing for an improved and efficient exercise and strengthening device specifically geared towards the muscles of the hand and forearm.

Yet another object of the present invention is to provide for a variable resistance hand gripper device that is successful and efficient in use, as well as lightweight and compact in size so as to provide for a device that can be readily employed when desired.

Yet another object of the present invention, to be specifically enumerated, is to provide a variable resistance hand gripper in accordance with the preceding objects, which will conform to conventional forms of manufacture, be of simple construction and easy to use so as to provide a device which would be economically feasible, long lasting, and relatively trouble free in operation.

Although there have been many inventions related to hand and finger exercising and strengthening devices, none of the inventions have demonstrated a device that offers varying resistance that is simple to change and alter. The present invention meets the requirements of the simplified design, compact size, low initial cost, low operating cost, ease of installation and maintainability, and minimal amount of training to successfully employ the invention.

The foregoing has outlined some of the more pertinent objects of the present invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DETAILED DESCRIPTION OF THE PREFERRED EMBODIMENT

Figures 1, 2, 3, 4:
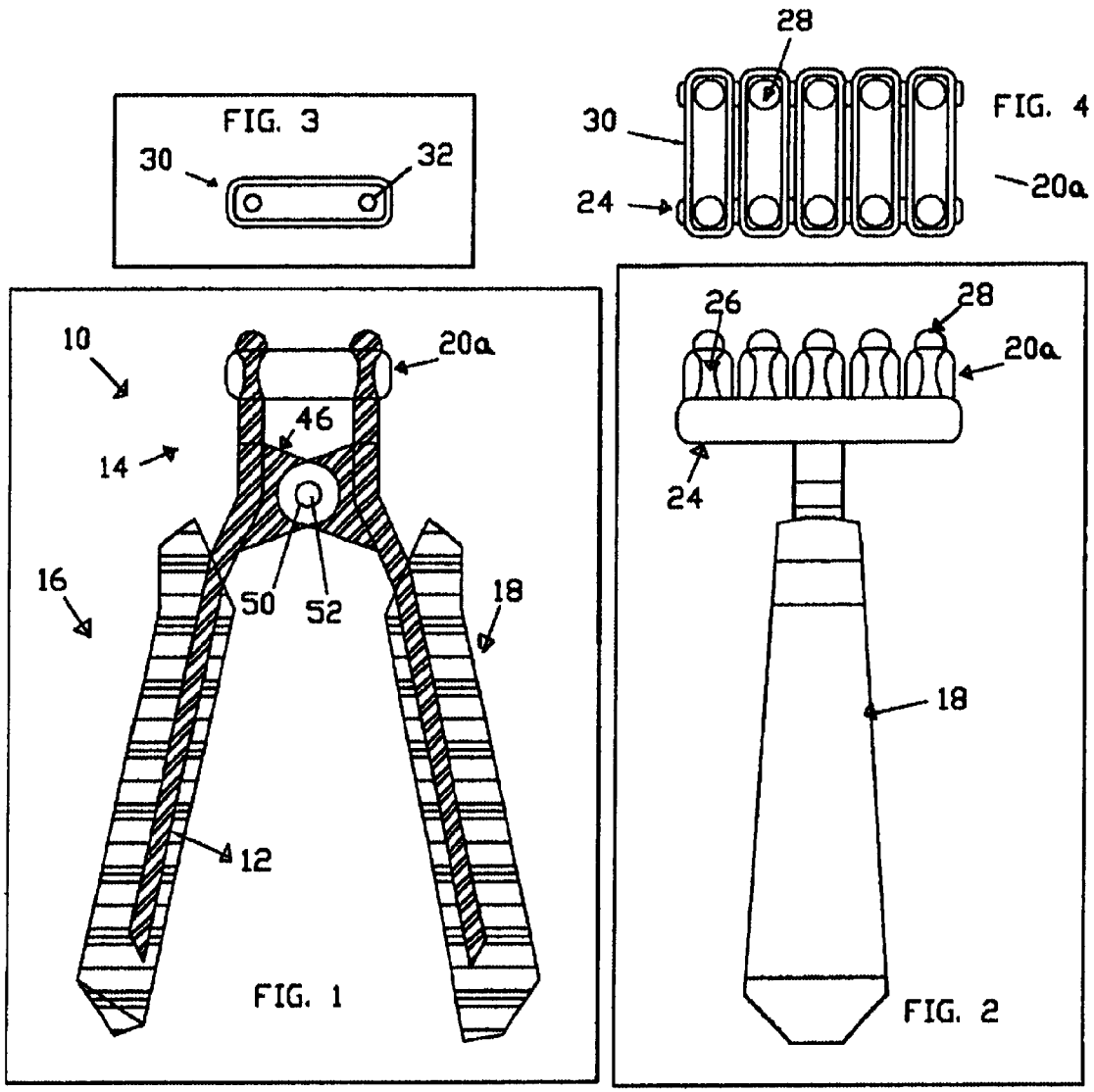
FIG. 1 is a top view of the first embodiment for the variable resistance hand gripper device of the present invention.
FIG. 2 is a side view of the first embodiment for the variable resistance hand gripper device of the present invention.
FIG. 3 is a top view of the variable resistance apparatus used in the variable resistance hand held gripper device of the first embodiment of the present invention, which is free from the resistance elements.
FIG. 4 is a top view of the variable resistance apparatus used in the variable resistance hand held gripper device of the first embodiment of the present invention which includes the resistance elements secured thereto.
Figure 8:
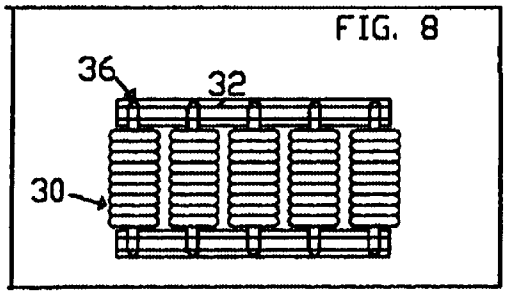
FIG. 8 is a top view of the variable resistance apparatus used in the variable resistance hand held gripper device of the second embodiment of the present invention, which includes the resistance elements secured thereto.

With reference to the drawings, in particular to FIGS. 1–9 thereof, the present invention, a variable resistance hand gripper device, denoted by reference numeral 10 will be described. Shown is a variable resistance hand gripper device 10 comprising a pair of handles 12. Each handle being a singular integral member having an upper section 14 and a lower section 16. The lower section being designed to receive the user's hand while the upper section includes a variable resistance apparatus. Preferably, the lower section is sized longer than the upper section for providing a universal size. This will enable users having either small or large hands to adequlately grip and maintain the lower section of the handles. As seen in the drawings, the lower section of the handles can include a cover or padding 18 fabricated from a resilient material. The purpose of this covering is to offer the user better gripping capabilities by preventing slippage as well as improved comfort. The pair of handles are identical in size and shape and when assembled, one handle is merely rotated and placed on top of the other handle.

Located at the upper section 14 of the handles is the variable resistance apparatus **20*a* in FIGS. 1–4 and 20*b* in FIGS. 5–8. As seen in FIGS. 1–4, the first embodiment for the variable resistance apparatus 20*a* used in the variable resistance hand gripper device 10, utilizes rubber bands 22 for its resistance elements. For properly achieving the resistance, the resistance apparatus 20*a* includes a frame member 24 that is perpendicularly located to the tip of the upper section 14 of each handle. This is shown in the side view, FIG. 2, of the first embodiment. Extending vertically from this frame member is a plurality of shafts 26. Each shaft includes an enlarged outer end 28. Thereby providing for each handle to have a set of vertical frame members that are alignable with each other. As seen in FIG. 2 and FIG. 4, the first set will be located above or next to the second set. Thus the rubber bands 30 would be maintained via the shafts, as seen in FIG. 4**. The enlarged tip maintains the band in placed. Increasing the number of rubber bands increases the resistance and thus makes the exercise more difficult. It is noted that the resistance apparatus, with the exception of the resistance elements, located on each handle, is integral with its respective handle. Thereby providing for each handle to include the resistance apparatus.

The bands 30 can be conventional or optionally can include a unique design and configuration, which increase the resistance and reduces the elasticity of conventional bands. This altered band 30 is seen in FIG. 3. As seen, the band includes a solid piece of elastic material having a pair of apertures 32 located at each end. The apertures are smaller in size than the tips of the shafts. To secure to the shaft, the apertures are forced over the tips, which inherently will increase in size due to its elasticity. Once passed the tip the apertures return to its original size and are consequently secured to the shaft. The use of a solid piece of resilient material for the band provides for a band possessing higher resistance characteristics.

The variable resistance apparatus can be altered to provide for a second embodiment for the variable resistance apparatus **20*b*. This alteration is illustrated in FIGS. 5–8. In this embodiment, the present invention 10 utilizes springs, coil wires or the like, 30 for its resistance elements. The springs or coils can be fabricated from any desirable and durable material. For properly achieving the resistance, the resistance apparatus 20*b* includes a frame member 24 that is perpendicularly located at the tip of the upper section 14 of each handle. This is shown in the side view, FIG. 5, of the second embodiment for the variable resistance apparatus 20***b*.

Extending through each frame member is a channel 32 that is adapted to removably receive a pin 34 or the like. The frame member further includes grooves 36 that are designed and configured to receive the ends of the springs. The grooves of one handle is alignable with the grooves of the second handle. The springs include outer ends 38 that include a receiving member. The receiving member is shown in the drawings as being an aperture that will receive the removable pin 34 for providing for the resistance element 30 to be secured to the frame member 24.

To assemble the apparatus for use, the desired number of springs for utilization is selected. The number is determined by the amount of resistance desired by the user. The harder or higher resistance, the more springs. The ends 38 of the spring is placed into the grooves 36 of the frame member 24. This will innately provide for the apertures of the springs to be aligned with the channel 32 of the frame member. Once all the springs are located therein, a pin is inserted into each channel.

Figure 7:
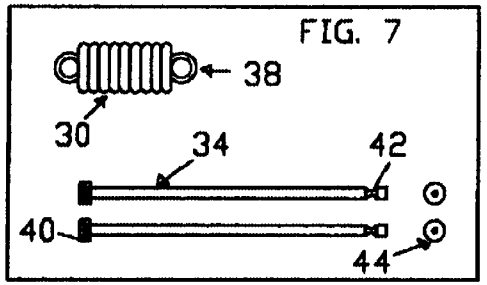
FIG. 7 is a top view of the variable resistance apparatus used in the variable resistance hand held gripper device of the second embodiment of the present invention, which is free from the resistance elements.
Figure 6:
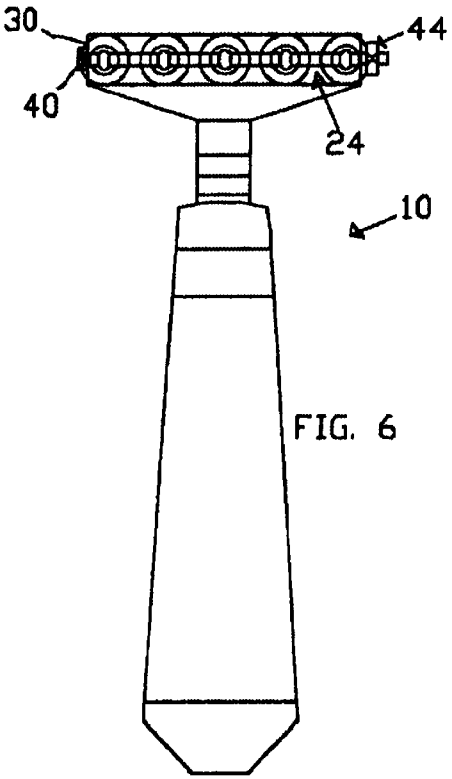
FIG. 6 is side view of the second embodiment for the variable resistance hand gripper device of the present invention.
Figure 5:
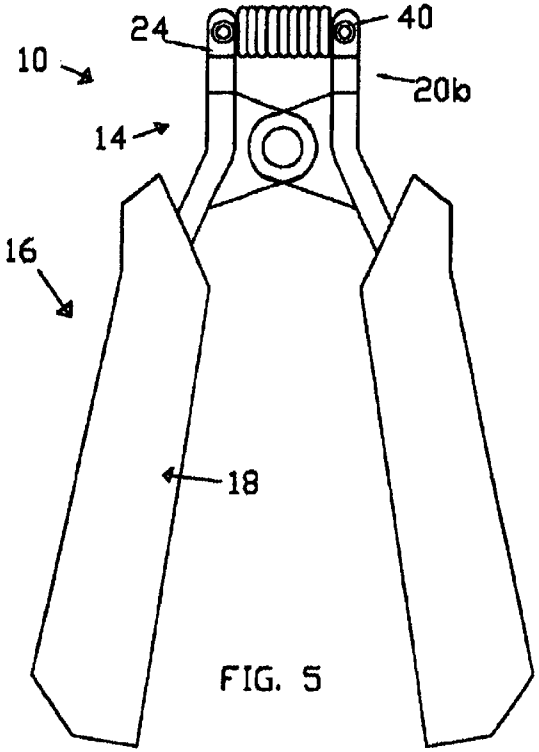
FIG. 5 is top view of the second embodiment for the variable resistance hand gripper device of the present invention.

As seen in FIGS. 5 and 7, the pin 34, includes one end 40 that is enlarge and a second end that includes a locking device 42. For proper assembly and for rendering proper disassembly of the resistance apparatus 20*b*, the second end including the locking device is inserted into the channel first so that the enlarged end will act as a stop and alert the user that the pin is properly in placed. The locking device 42 can be any conventional form of locking devices. For illustrative purposes, one type of locking device that has been used is the use of rubber washer 44 having an opening located therein. The second end includes an area that is enlarged as well as a seat. The washer 44 is designed to operate in the same manner as the rubber bands as used with the first embodiment. Thus the opening is forced over the enlarged end, which inherently will increase in size due to its elasticity. Once passed the tip the opening return to its original size and remains in placed in the seat of the pin. When secured, the washer will be located exteriorly with respect to the channel, as seen in FIG. 6.

Coupling the handles together is a pivot member that provides for the user to press the handles towards each other. Upon release of force, will still maintaining the handles, the resistance elements (i.e. bands or springs) will return to their normal state, consequently providing for the handles to move away from one another. The hinge member enables for movement and also defines the sections of the handles. This hinge member defines the sections. Thereby providing for the area above the hinge to be defined as the upper area and the area below the hinge to be defined as the lower area. The upper area and lower area of each handle, including the resistance apparatus and the pivot member form a unitary structure.

Figure 9:
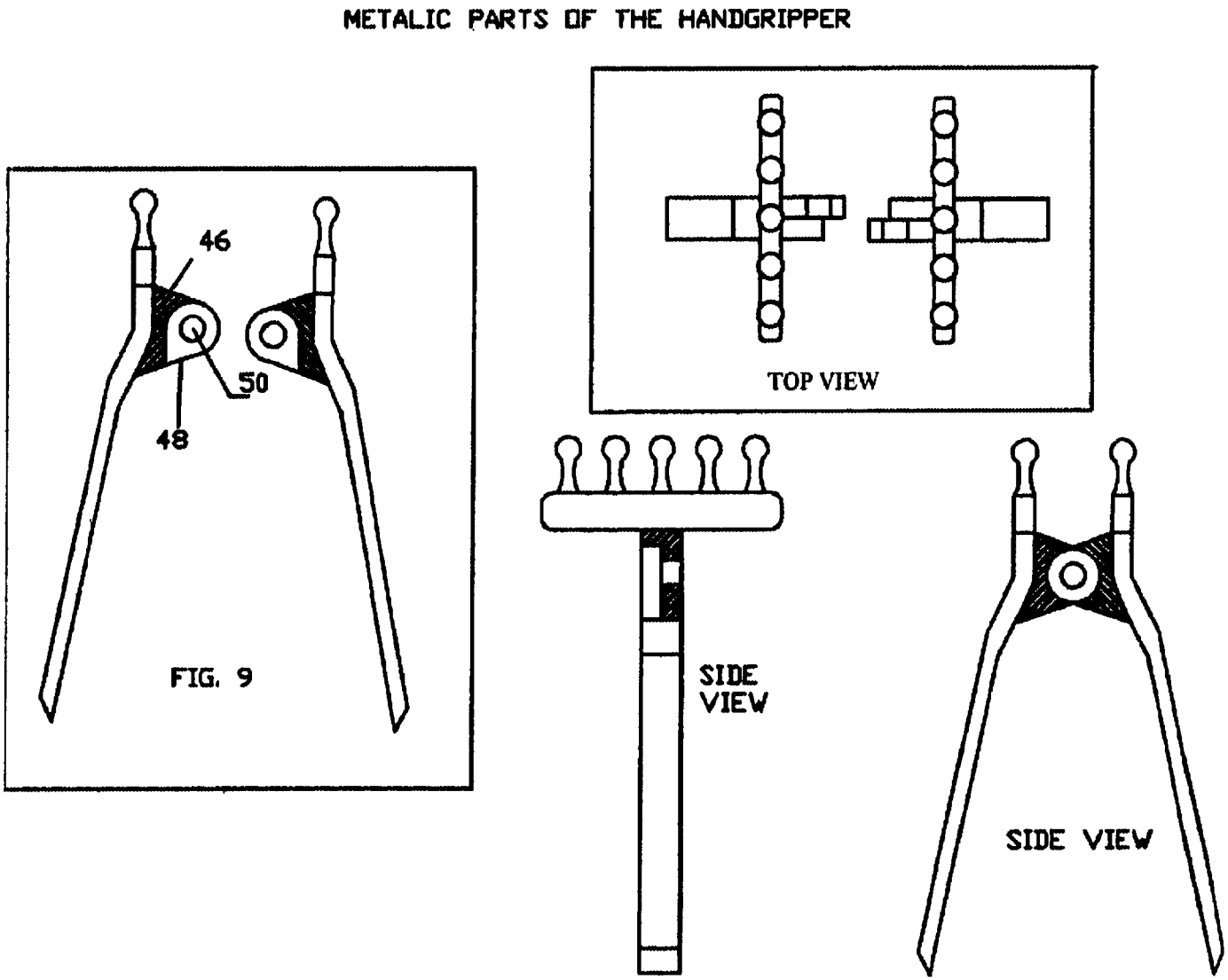
FIG. 9 is a detail view of the hinge member used in the handles of the variable resistance hand gripper device of the present invention.

As seen in FIG. 9, the handles are identical in size and shape and form an integral structure. Extending outward from each handle is a flange member 46. The flange member 46 includes a recess portion 48 having an outer end that is curved. Extending though the recess portion is a through hole 50 that is designed and configured to receive a conventional pivot pin 52 illustrated in FIG. 1. To assembly the handle, the recess member of one handle is mated with the recess member of the second handle. Once positioned, the conventional pivot pin 52 is inserted therein to provide for the handles to be secured to each other and enable the assembly to be utilized as desired.

While the present invention has been particularly shown and described with reference to an embodiment thereof, it will be understood by those skilled in the art that various changes in form and detail may be made without departing from the spirit and scope of the present invention.

I claim:

1. A variable resistance apparatus comprising:

a pair of handles pivotally secured to each other via a pivot device;

each handle including an upper section, a lower section and a shaft;

a resistance assembly is located at said upper section;

said pivot device is secured at a point, which defines said upper section and said lower section;

said resistance assembly includes a removable attachment devices for altering resistance of said resistance assembly, and;

and frame member perpendicularly located said upper section of said handles, a plurality of shafts extend perpendicularly from each fame member, said removable attachment devices are removably secured to said plurality of shafts.

2. A variable resistance apparatus as in claim 1 wherein each handle includes a cover used for padding.

3. A variable resistance apparatus as in claim 1 wherein said removable attachment device comprises a plurality of rubber bands.

4. A variable resistance apparatus as in claim 1 wherein said removable attachment device comprises a plurality of spring members.

5. A variable resistance apparatus as in claim 4 wherein said removable attachment devices are a plurality of rubber bands.

6. A variable resistance apparatus as in claim 5 wherein each rubber band comprises a solid piece of resilient material having a pair of apertures extending therethrough, each aperture will receive said shaft of each handle.

7. A variable resistance apparatus comprising:

A pair of handles pivotally secured to each other by a pivot device;

each handle including an upper section and a lower section;

A resistance assembly is located at said upper section;

said pivot device is secured at a point, which defines said upper section and said lower section;

said resistance assembly includes at least one removable attachment device for altering resistance of said resistance assembly, and; a frame member perpendicularly located on said upper section of said handles, a channel extending through each frame member; a plurality of grooves are located in each frame member and are alignable with said channel, a locking device is removably secured to said channel, said removable attachment device is removably secured to at least one of said plurality of grooves and is secured in placed by said locking device.

8. A variable resistance apparatus as in claim 7 wherein said removable attachment devices being spring members.

9. A variable resistance apparatus as in claim 7 wherein said spring members comprises outer ends and located at each outer end is a loop member and said loop member is removably located in said grooves.

10. A variable resistance apparatus as in claim 7 wherein said locking device is a locking pin.

11. A variable resistance apparatus as in claim 1 wherein said lower section of each handle is padded.

* * * * *